US006788176B2

(12) United States Patent
Schmelz

(10) Patent No.: US 6,788,176 B2
(45) Date of Patent: Sep. 7, 2004

(54) BOUNCE-REDUCED RELAY

(75) Inventor: Rainer Schmelz, Wellendingen (DE)

(73) Assignee: Gruner AG (DE)

( * ) Notice: Subject to any disclaimer, the term of this patent is extended or adjusted under 35 U.S.C. 154(b) by 0 days.

(21) Appl. No.: 10/686,441

(22) Filed: Oct. 14, 2003

(65) Prior Publication Data

US 2004/0080388 A1 Apr. 29, 2004

(30) Foreign Application Priority Data

Oct. 25, 2002 (DE) ..... 102 49 697

(51) Int. Cl.[7] ..... H01H 51/22

(52) U.S. Cl. ..... 335/80; 335/78; 335/124; 335/129

(58) Field of Search ..... 335/78–85, 124, 335/128, 129, 132

(56) References Cited

U.S. PATENT DOCUMENTS 4,290,037 A * 9/1981 Inagawa et al. ..... 335/202
6,023,212 A * 2/2000 Mader ..... 335/202
6,025,766 A * 2/2000 Passow ..... 335/785
6,046,661 A 4/2000 Reger et al.
6,340,923 B1 * 1/2002 Yamanaka et al. ..... 335/4
6,426,689 B1 * 7/2002 Nakagawa et al. ..... 335/78
6,661,319 B2 * 12/2003 Schmelz ..... 335/78
2001/0038326 A1 * 11/2001 Dittemann ..... 335/80
2002/0038326 A1 * 3/2002 Nakamura et al. ..... 335/128

FOREIGN PATENT DOCUMENTS

DE 197 15 261 C1 12/1998

* cited by examiner

*Primary Examiner*—Lincoln Donovan
*Assistant Examiner*—Bernard Rojas
(74) *Attorney, Agent, or Firm*—Walter A. Hackler

(57) ABSTRACT

In a relay (1) with two parallel contact springs (2*a*, 2*b*) which close or interrupt the electric circuit between a first and a second relay contact (3, 4), whose one end is connected in a conducting fashion to the first relay contact (3) and whose other free end (5*a*; 5*b*) closes or interrupts the electric circuit in a first end position and a second end position of the contact springs (2*a*, 2*b*), respectively, and with an armature (11) which can be adjusted by means of a magnetic field whose poles can be changed, for deflecting the contact spring (2*a*, 2*b*) into the respective end position, in accordance with the invention, a leaf spring (17) is centrally pivotably disposed on the armature (11) or its actuator (14) whose two free ends (18*a*, 18*b*) bias the two contact springs (2*a*, 2*b*) with force into the first end position.

8 Claims, 3 Drawing Sheets

BOUNCE-REDUCED RELAY

The invention relates to a relay with two contact springs, which each close or interrupt the electric circuit between a first and a second relay contact and whose one end is connected in a conducting fashion with the first relay contact and whose other free end closes or interrupts the electric circuit in a first end position and a second end position of the contact springs, respectively, and with an armature which can be adjusted by means of a magnetic field, whose poles can be changed, for deflecting the contact springs into the respective end position.

A relay of this type is disclosed e.g. in DE 197 15 261 C1.

In this known relay, an electric circuit between two electric relay contacts is closed or interrupted by means of two parallel contact springs. The contact springs are in connection via a displaceable actuator to a permanent magnet of an H-armature which is pivotably retained on two yoke legs of a magnet coil. When the poles of the magnet coil are changed, the permanent magnet is pivoted thereby displacing the actuator. Thereby as the contact springs are grasped behind by the actuator they are deflected from their closed rest position such that the electric circuit is interrupted. The free ends of the contact springs are each biased with force in the direction towards the closed end position by one leaf spring which is mounted to the respective contact spring and is supported with its free end on the actuator.

It is the object of the invention to further develop a relay of the above-mentioned type such that the contact forces acting between the two contact springs and their second relay contacts are as equal as possible and the contact bouncing time of the relay is as minimal as possible.

This object is achieved in accordance with the invention in that a leaf spring is centrally pivotably disposed on the armature or its actuator, whose two free ends bias the two contact springs into the first end position with force.

In the closed relay position, the leaf spring counteracts the deflection of the two contact springs in the opening direction which reduces bouncing when the relay closes. If the contact springs do not close simultaneously, the leaf spring is pivoted by the armature or its actuator towards the lagging contact spring as soon as the leading contact spring abuts its relay contact. Thereby the lagging contact spring is increasingly loaded with force into its closed relay position whereby the closing time is reduced and bouncing is reduced when the lagging contact spring is closed and the contact forces acting between the two contact springs and their second relay contacts are matched. This reduces the bouncing time of the overall relay in total.

The free ends of the leaf spring are preferably arc-shaped in the direction towards the contact springs such that they can slide with minimum friction on the contact springs when the leaf spring is pivoted. In the most simple case, the leaf spring is retained on the armature or actuator in a clamping fashion along a clamping line defining the pivoting axis of the leaf spring.

The leaf spring is preferably formed from electrically conducting material but may also be formed from electrically insulating material e.g. plastic material. In the latter case, two separate electric circuits can be switched.

The two contact springs are formed either in one piece e.g. as U-shaped leaf spring with two parallel free ends or as two separate leaf springs which are either electrically connected or electrically insulated from each other. In the latter case, two separate electric circuits can be switched.

The actuator is preferably disposed to be linearly displaceable approximately in the deflecting direction of the contact springs and is motionally coupled to the free ends of the contact springs. The contact springs are preferably directly coupled with the armature or its actuator in the opening direction of the relay and motionally coupled with the armature or its actuator in the closing direction of the relay via the leaf spring.

Further advantages of the invention can be extracted from the description and the drawing. The features mentioned above and below can be used in accordance with the invention either individually or collectively in arbitrary combination. The embodiments shown and described are not to be understood as exhaustive enumeration but rather have exemplary character for describing the invention.

Figure 1:
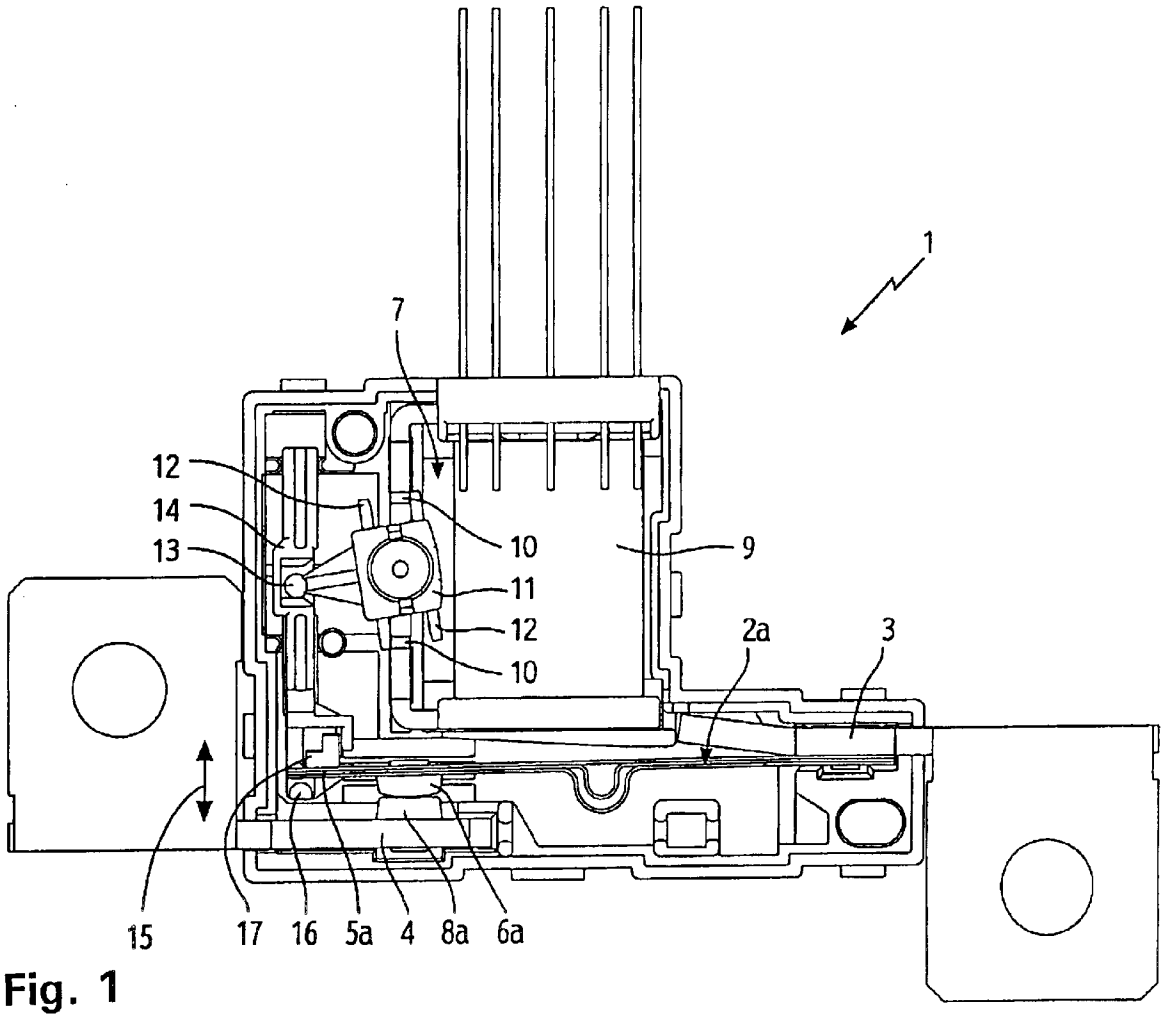
FIG. 1 shows a side view of the inventive relay in the closed relay position in which two parallel contact springs each close the electric circuit between two relay contacts with removed cover.
Figure 2:
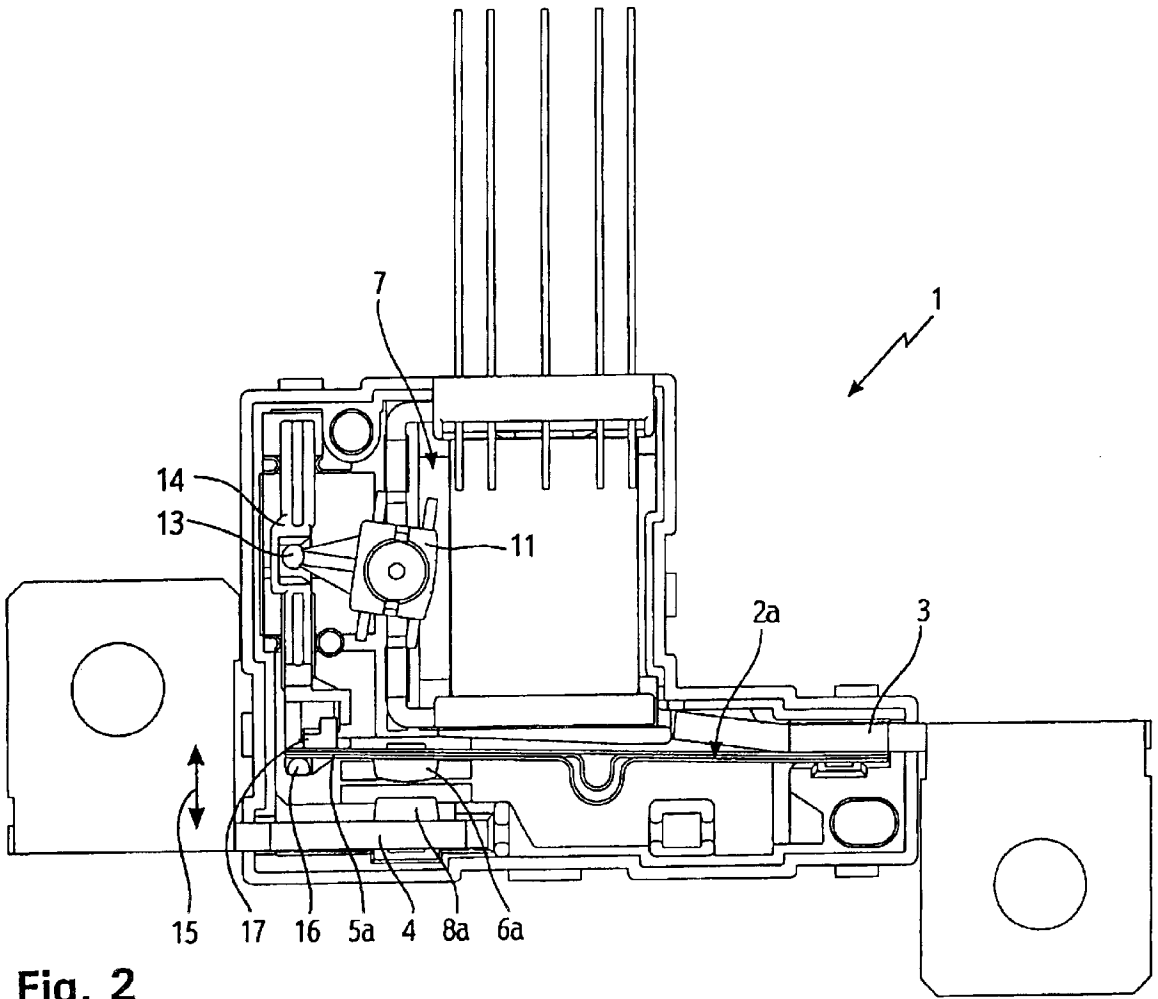
FIG. 2 shows the inventive relay in the open relay position in which the two contact springs each interrupt the electric current between the two relay contacts.
Figure 3:
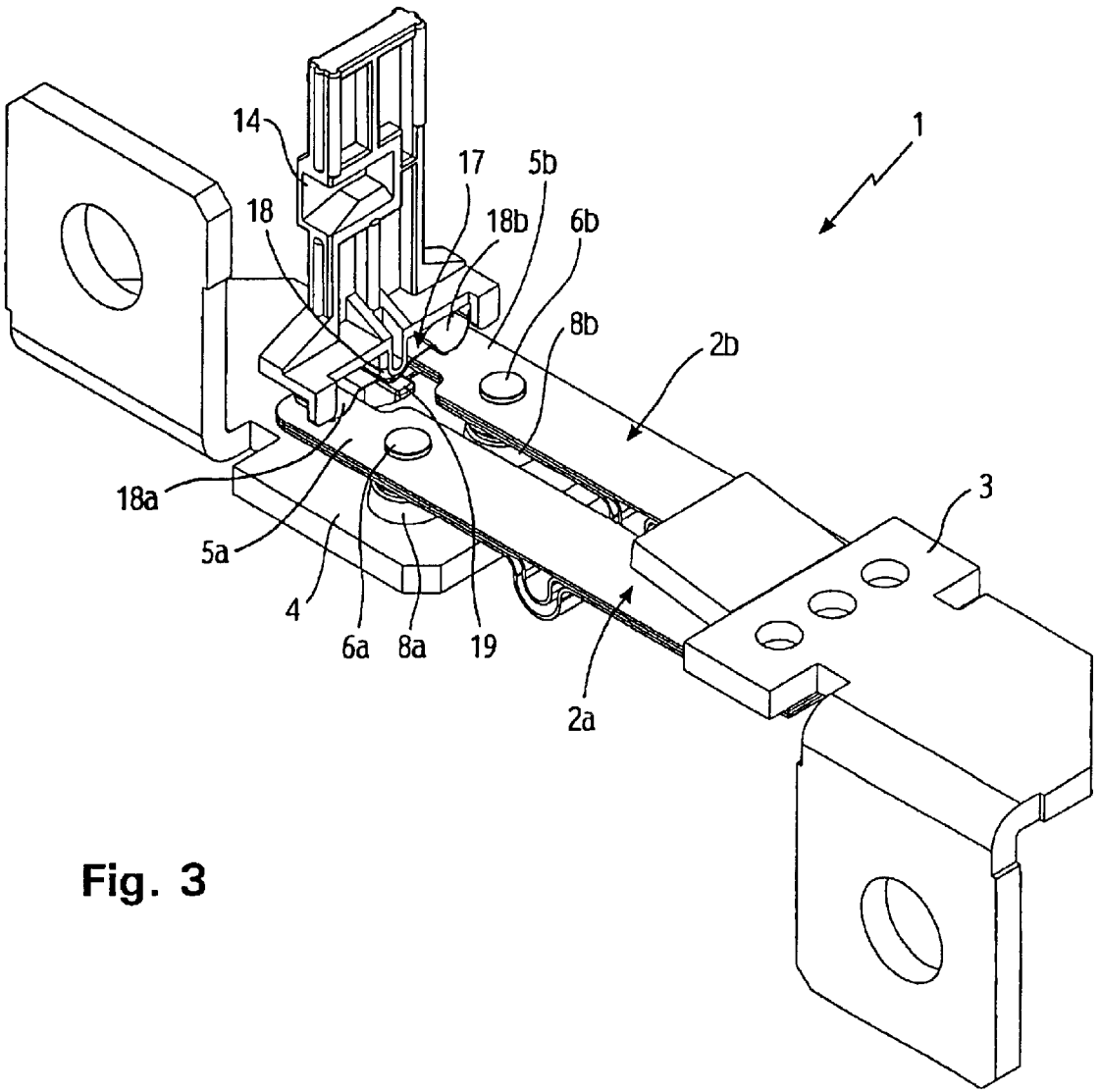
FIG. 3 shows a perspective detailed view of the inventive relay in the region of a leaf spring biasing the two contact springs with force into the closed relay position.

The relay 1 shown in FIGS. 1–3 comprises two parallel contact springs 2*a*, 2*b* (FIG. 3) which are formed as electrically conducting leaf or plate springs which each close or interrupt the electric circuit between two relay contacts 3,4. The one ends of the contact springs 2*a*, 2*b* are mounted to the first relay contact 3 in an electrically conducting fashion while the other free ends 5*a*, 5*b* each bear a contact button 6*a*, 6*b* and can be deflected by means of a common magnet drive 7.

The contact springs 2*a*, 2*b* are deflected downwardly in the closed relay position shown in FIG. 1 such that the contact buttons 6*a*, 6*b* each abut a contact button 8*a*, 8*b* of the second relay contact 4 and are deflected upwardly in the open relay position shown in FIG. 2 such that the contact buttons 6*a*, 6*b* are lifted from the contact buttons 8*a*, 8*b* of the second relay contact 4.

The magnet drive 7 comprises a magnet coil 9 whose poles can be changed comprising an iron core whose two yoke legs 10 pivotably hold an armature 11 with a permanent magnet (not shown). The permanent magnet is disposed between two armature plates 12 which abut the yoke legs 10 in both switching positions of the armature 11. The magnet coil 9 and the armature 11 which can be pivoted between its two switching positions, form an H armature attraction.

A rod-shaped actuator 14 is hinged to a protruding arm 13 of the armature 11 which is linearly displaceably disposed in the deflecting direction (double arrow 15) of the contact springs 2*a*, 2*b*. A projection 16 of the actuator 14 engages below the free ends 5*a*, 5*b* of the contact springs 2*a*, 2*b* whereby the actuator 14 carries or deflects the contact springs 2*a*, 2*b* in the opening direction of the relay 1 i.e. upwardly. As shown in FIG. 3, the contact springs 2*a*, 2*b* are motionally coupled with the actuator 14 in the closing direction, i.e. downwardly, by means of a leaf spring 17 of spring steel mounted to the actuator 14. The leaf spring 17 is centrally pivotably disposed on the actuator 14 and acts with its two free ends 18*a*, 18*b* on the contact springs 2*a*, 2*b*. The free ends 18*a*, 18*b* of the leaf spring 17 are bent downwards in the direction of the contact springs 2*a*, 2*b* like an arch.

In the embodiment shown, the leaf spring 17 is retained in a slot-shaped clamping receptacle which is formed by two projections 18, 19 of the actuator 14. The projections 18, 19 have rounded clamping surfaces which define the pivot axis of the leaf spring 17.

To switch the relay 1, the poles of the magnet field of the magnet coil 9 are changed whereby the armature 11 is deflected and the actuator 14 is displaced. In the closed relay position (FIG. 1), the actuator 14 is displaced downwardly by the downwardly pivoted arm 13 whereby also the contact springs 2*a*, 2*b* are pivoted via the leaf spring 17 downwardly until their contact button 6*a*, 6*b* abuts the contact buttons 8*a*, 8*b* of the second relay contact 4. The pressure force of the contact buttons 6 acting on those of the second relay contact 3 is provided by the pressure of the leaf spring 17 compressed by the actuator 14. In the closed relay position, the leaf spring 17 counteracts the deflection of the contact springs 2*a*, 2*b* in the opening direction resulting in a bounce-reduced closure of the relay 1.

When the contact springs 2*a*, 2*b* do not close at the same time, the leaf spring 17 is pivoted by the actuator 14 in the direction of the lagging contact spring as soon as the leading contact spring abuts its relay contact. The lagging contact spring is thereby biased with even more force into its closed relay position whereby a shorter closing time and a bounce-reduced closing of the lagging contact spring are caused and the contact forces acting between the two contact springs and their second relay contacts are matched. This results in a reduction of the bouncing time of the overall relay in total.

In the open relay position (FIG. 2), the actuator 14 is pivoted upwardly by the upwardly pivoted arm 13 thereby carrying along the contact springs 2*a*, 2*b* from the projection 16 of the actuator 14 and lifting the contact buttons 6*a*, 6*b* from the contact buttons 8*a*, 8*b* of the second relay contact 4.

What is claimed is:

1. Relay (1) with two parallel contact springs (2*a*, 2*b*) which each close or interrupt the electric circuit between a first and a second relay contact (3, 4) and whose one end is connected in a conducting fashion with the first relay contact (3) and whose other free end (5*a*; 5*b*) closes or interrupts the electric circuit in a first end position and a second end position of the contact springs (2*a*, 2*b*), respectively, and with an armature (11) which can be adjusted by means of a magnetic field, whose poles can be changed, for deflecting the contact springs (2*a*, 2*b*) into the respective end position, characterized in that a leaf spring (17) is centrally pivotably disposed on the armature (11) or its actuator (14) whose two free ends (18*a*, 18*b*) bias the two contact springs (2*a*, 2*b*) with force into the first end position.

2. Relay according to claim 1, characterized in that the free ends (18*a*, 18*b*) of the leaf spring (17) are arc-shaped.

3. Relay according to claim 1 or 2, characterized in that the leaf spring (17) is clamped on the armature (11) or on the actuator (14).

4. Relay according to any one of the preceding claims, characterized in that the leaf spring (17) is formed of electrically conducting material.

5. Relay according to any one of the preceding claims, characterized in that the two contact springs (2*a*, 2*b*) are formed in one piece.

6. Relay according to any one of the claims 1 through 4, characterized in that the two contact springs (2*a*, 2*b*) are formed as separate leaf springs.

7. Relay according to any one of the preceding claims, characterized in that the actuator (14) is linearly displaceably disposed approximately in the deflecting direction (15) of the contact springs (2*a*, 2*b*).

8. Relay according to any one of the preceding claims, characterized in that the contact springs (2*a*, 2*b*) are directly coupled with the armature (11) or the actuator (14) in the opening direction of the relay (1) and are motionally coupled in the closing direction of the relay (1) with the armature (11) or the actuator (14) via the leaf spring (17).

* * * * *